US005718297A

United States Patent [19]

Weber

[11] Patent Number: 5,718,297

[45] Date of Patent: Feb. 17, 1998

[54] HYDRAULIC IMPACT HAMMER

[75] Inventor: Emil Weber, Kilchberg-Zuerich, Switzerland

[73] Assignee: Guenter Klemm, Germany

[21] Appl. No.: 537,740

[22] PCT Filed: Feb. 10, 1995

[86] PCT No.: PCT/EP95/00479

§ 371 Date: Dec. 28, 1995

§ 102(e) Date: Dec. 28, 1995

[87] PCT Pub. No.: WO95/22442

PCT Pub. Date: Aug. 24, 1995

[30] Foreign Application Priority Data

Feb. 19, 1994 [DE] Germany ..... 44 05 381.9

[51] Int. Cl.[6] ..... B25D 9/04

[52] U.S. Cl. ..... 173/206; 173/112; 173/207; 173/208; 91/290; 91/303

[58] Field of Search ..... 173/206, 207, 173/208, 135, 137, 138, 112, 113; 91/276, 281, 290, 303

[56] References Cited

U.S. PATENT DOCUMENTS

| | | | |
|---|---|---|---|
| 3,322,210 | 5/1967 | Arndt | 173/208 |
| 4,466,493 | 8/1984 | Wohlwend | 173/19 |
| 4,676,323 | 6/1987 | Henriksson | 173/208 |
| 5,010,963 | 4/1991 | Neroznikov et al. | 173/208 |
| 5,134,989 | 8/1992 | Akahane | 173/206 |
| 5,279,120 | 1/1994 | Sasaki | 173/208 |
| 5,392,865 | 2/1995 | Piras | 173/208 |

*Primary Examiner*—Joseph J. Hail, III
*Assistant Examiner*—Jay A. Stelacone
*Attorney, Agent, or Firm*—Diller, Ramik & Wight, PC

[57] ABSTRACT

The impact hammer comprises a working piston (22) exerting impacts onto an impact surface (23). The hydraulically driven working piston (22) is reciprocatingly controlled by a control means (40,41). At the rearward end of the working cylinder (21), there is a rear chamber (50) into which the projection of the piston (51) immerses. Connected to the rear chamber (50) is a pressure gas reservoir (52) which is charged with each return stroke of the working piston and discharges with the subsequent working stroke.

12 Claims, 3 Drawing Sheets

HYDRAULIC IMPACT HAMMER

BACKGROUND OF THE INVENTION

The invention relates to a hydraulic impact hammer, particularly for advancing objects in the ground.

From patent DE 30 23 538 C2, a hydraulic impact hammer having the features of the precharacterizing part of claim 1 is known. This impact hammer has a pressure gas reservoir connected to the rear chamber of the working cylinder, the gas chamber of said pressure gas reservoir being closed by a membrane upon the outside of which the hydraulic fluid contained in the rear chamber of the working cylinder acts. The rear chamber is connected to a supply line via an inflow line including a pressure-controlled valve. Further, the rear chamber is connected to a control means via a second line in order to reverse the control body of the control means into that state in which the control means causes the return stroke of the working piston. Therefore, the second line is a pure pressure control line through which no pressure fluid is transported. The pressure-controlled valve connects the rear chamber of the working cylinder to the supply line when the working piston has reached its forward end position. During the return stroke of the working piston, the pressure in the rear chamber increases. If this pressure exceeds a determined value, then the pressure-controlled valve will connect the rear chamber with the return line. Thus, pressure fluid is pumped by the working piston and a certain exchange of the fluid quantity contained in the rear chamber is effected. The main portion of the impact energy is applied by the pressure gas reservoir. Because pressure fluid is drained off the rear chamber of the working piston when the pressure in this rear chamber has reached its maximum value, a portion of the pressure energy gets lost, whereby the efficiency of the impact hammer deteriorates.

SUMMARY OF THE INVENTION

It is the object of the invention to provide a hydraulic impact hammer with which the ratio of impact energy to power consumption is improved.

In the impact hammer according to the invention, the rear chamber is completely sealed off when the working piston leaves its forward end position until the rearward return point is reached, and preferably until the working piston has reached its forward end position again. A particular advantage lies in that no pressure energy gets lost. It is true that an increased pressure force has to be expended for the return stroke of the working piston, this additionally expended energy, however, is recovered when the pressure gas reservoir relaxes. Then, the oil displaced by the return stroke surface of the working piston is supplied to the pressure supply system again, so that the hydraulic pressure energy consumption of the impact drilling hammer altogether is not higher than that of an impact drilling hammer without pressure gas reservoir. Nevertheless is the impact energy obtained with the aid of the pressure gas reservoir substantially greater than with a system without pressure gas reservoir. The pressure-controlled valve makes sure that a defined pressure prevails in the rear chamber of the working cylinder at the beginning of the return stroke. In the course of the return stroke of the working piston, this pressure continuously increases because the working piston moves into a completely sealed-off system from which no pressure fluid escapes. Therefore, no energy losses occur, except for frictional losses. Further, it is achieved that the pressure gas reservoir raises a defined braking energy for the return stroke, the braking force continuously increasing with the return stroke path of the working piston without any pressure impacts or shocks occurring.

During the impact operation, the hydraulic fluid sealed in the rear chamber of the working cylinder heats up. In order to avoid an excessive heating of this pressure oil, the rear chamber is suitably connected to an inflow line and an outflow line, which are only open for causing an oil flow through the rear chamber when the working piston is near its forward end position. In this state, the rear chamber has its largest volume and the pressure in the rear chamber assumes its minimum value. Then, hydraulic oil flows through the pressure chamber for a short time until the working piston performs its return stroke. During the return stroke, the flow path through the inflow line and through the outflow line is interrupted. The liquid sealed in the rear chamber then is subjected to a continuously increasing pressure, the gas contained in the pressure gas reservoir being compressed. The flow-through through the rear chamber serves to partially renew the oil contained in the rear chamber for the purpose of heat dissipation, on the one hand, and to generate a defined pressure in the rear chamber before the compression phase, on the other hand. Possible oil losses past the working piston are replaced after each working stroke.

A particularly good efficiency is obtained when the pressure gas reservoir is used in combination with an impact hammer wherein the return stroke chamber is constantly subject to the high supply pressure. That pressure fluid displaced from the rear chamber during the working stroke remains under pressure and is not relaxed into the tank.

Generally, the invention is applicable for advancing objects, e.g., sheet piles, but it is also suitable for rock breakers and drilling devices. Preferably, the impact hammer is arranged as an outer hammer on the rearward end of the object, but it may also be configured as in-hole hammer.

BRIEF DESCRIPTION OF THE DRAWINGS

Hereinafter, embodiments of the invention are explained in more detail with respect to the drawings.

In the Figures.

DESCRIPTION OF THE PREFERRED EMBODIMENTS

Figure 2:
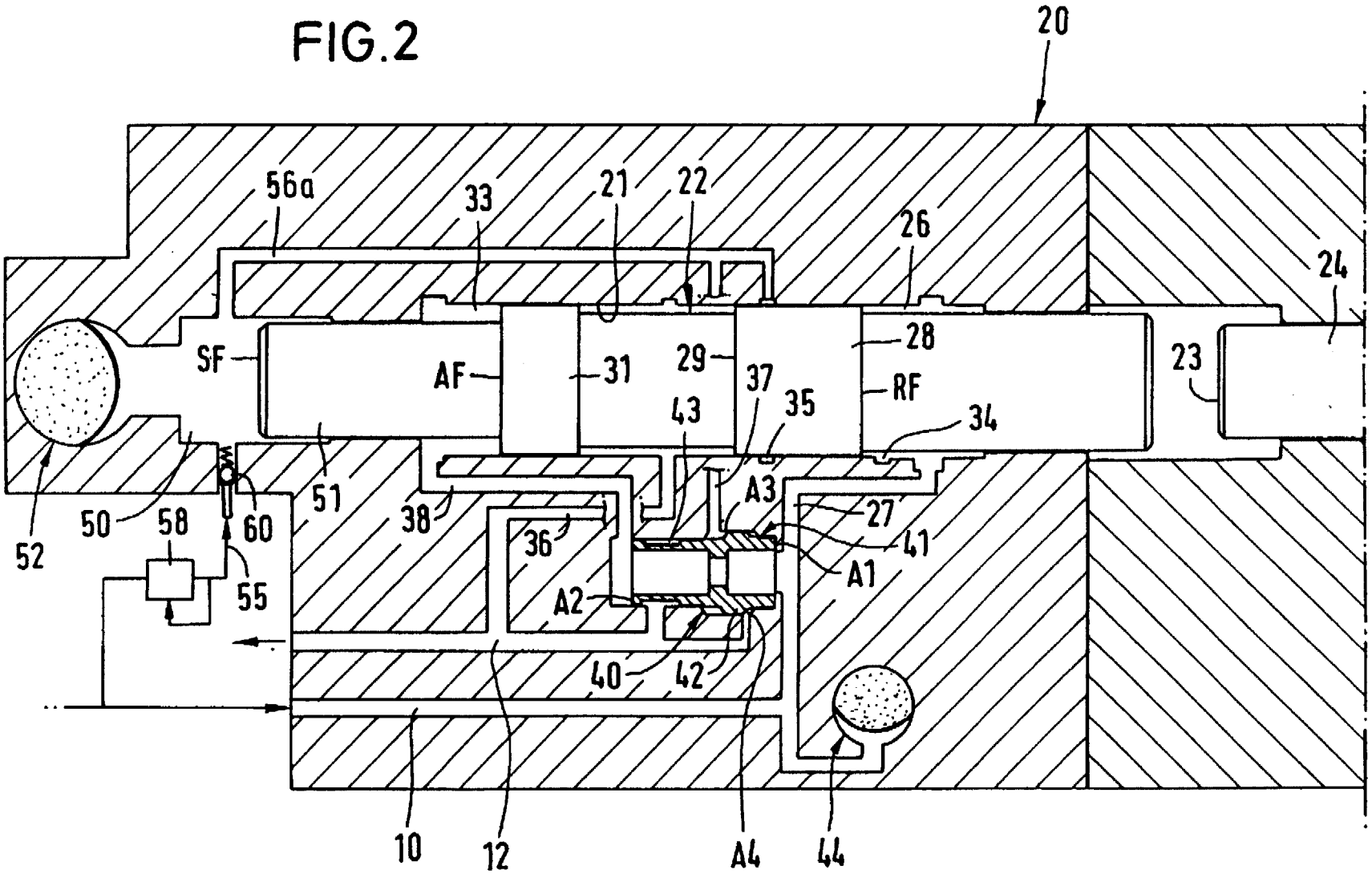
FIG. 2 is a schematic longitudinal section through a second embodiment of the impact hammer.

The drilling hammer shown in FIG. 2 comprises a hammer housing 20 being connected to a pressure line 10 and a pressureless return line 12 and including a working cylinder 21. The working piston 22 is guided in the working cylinder 21. The front end of the working piston 22 strikes onto an anvil surface 23 of an adapter 24 guided in the hammer housing 20 so as to be restrictedly longitudinally displaceable. The adapter 24 is coupled with the object to be advanced. "Forward" respectively means that direction pointing to the advance direction, and "rearward" means the opposite direction.

The working piston 22 comprises a forwardly directed annular return stroke surface RF limiting the annular front cylinder chamber (return stroke chamber) 26. This cylinder chamber 26 is permanently connected to the pressure line 10 via a line 27. The return stroke surface RF limits an enlarged section 28 of the working piston. The other limitation of the section 28 is formed by a ring surface 29 joined by a thinner section 30. At the rear of the thinner section 30, there follows a thicker section 31 again whose rearward end is formed by a working surface AF. The working surface AF limits the rearward cylinder chamber 33 of the working cylinder 21. The working surface AF is larger than the return stroke surface RF by a factor of between 2 to and 3.

The return stroke surface RF moves along several control grooves 34*a*, 34*b*, 34*c* in the forward cylinder chamber 26. The ring surface 29 moves along a control groove 35. In the region of the thinner section 30 of the working piston, a line 36 connected to the return line 12 opens into the working cylinder 21. The control grooves 34*a*, 34*b*, 34*c* are connected to a control line 37. Of each of these connections, two are closed by closing devices 32, whereas one is open. The control groove 35 is permanently connected to the control line 37. The rearward cylinder chamber 33 of the working cylinder is connected to an operating line 38.

The control of the working piston 22 is effected by the control piston 41 which is movable in the control cylinder 40. The control piston 41 is configured as a hollow sleeve. Since the control cylinder 40 is connected to the pressure line 27, there is always the full hydraulic pressure in the interior of the control piston 41. At one end, the control piston 41 comprises a first working surface A1 which is constantly subject to the pressure and comprises radial grooves so that the pressure may engage thereon. At the opposite end of the working piston, there is a second working surface A2 which is smaller than the working surface A1. The control piston is provided with an annular collar 42 which is limited by a control surface A3 at the one end and, at the opposite end, by a constantly pressureless surface A4 connected to the return line 12. The control surface A3 is subject to the pressure of the control line 37. Further, the control piston 41 is provided with an annular groove 43 which communicates with the return line 12 in any position of the working piston. The pressure line 27 is a pressure gas reservoir 44 being connected as a buffer for smoothing the hydraulic pressure shocks.

Figure 1:
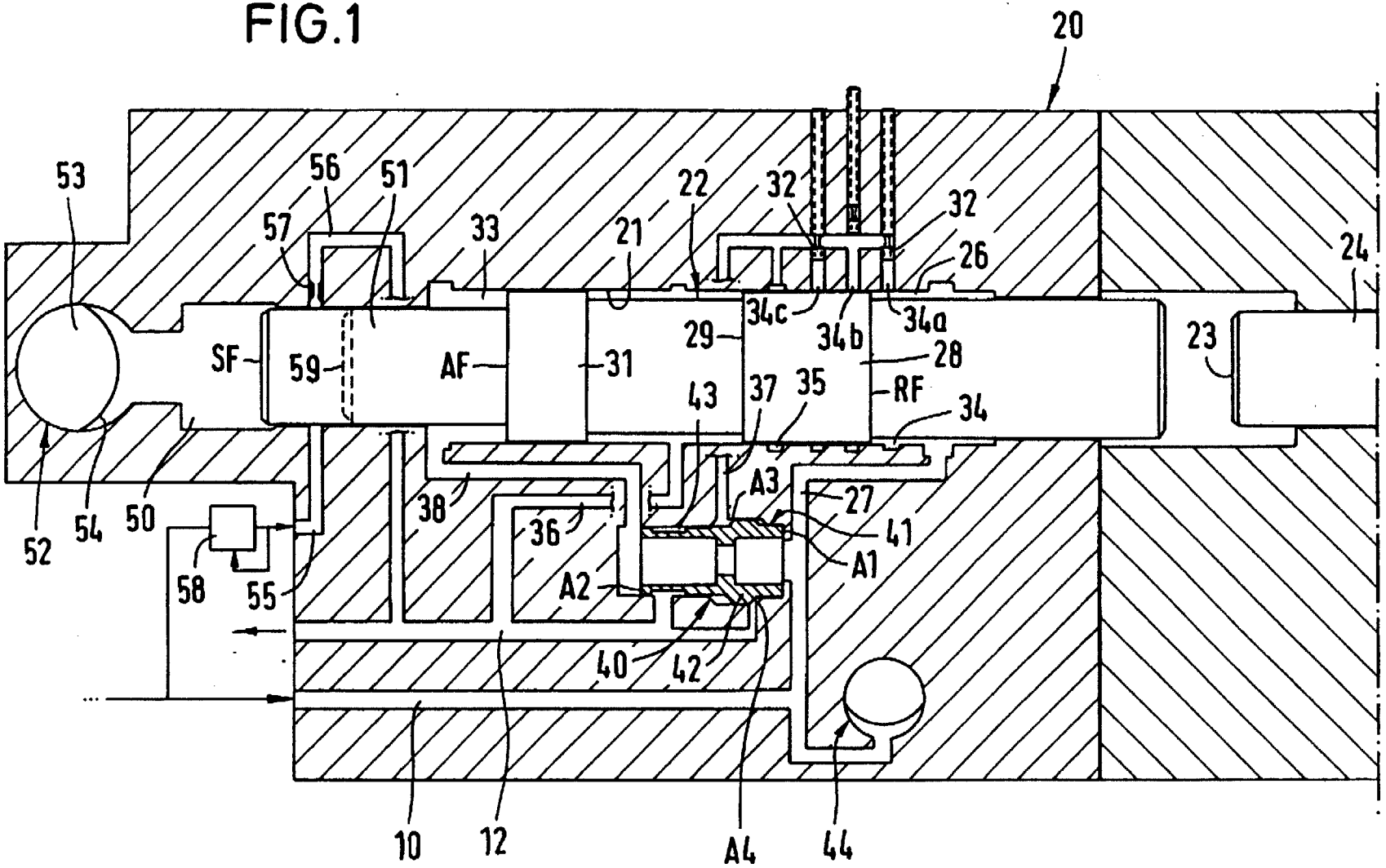
FIG. 1 is a schematic longitudinal section through a first embodiment of the impact hammer.

The impact apparatus described so far operates as follows:

In the state shown in FIG. 1, the operating line 38 is connected with the pressure line 22 via the interior of the control piston 41, so that the full pressure acts upon the working surface AF. Since the working surface AF is larger than the return stroke surface RF upon which the full pressure acts as well, the working piston performs its forwardly directed working stroke at the end of which it strikes onto the anvil surface 23. As soon as the return stroke surface RF has passed the open control groove 34*b*, the control line 37 is separated from the pressure line 27. When the control surface 29 has passed the control groove 35, the control line 37 is connected to the line 36 via the groove 35 and becomes pressureless thereby. Therefore, there is no longer pressure acting upon the control surface A3 of the control piston 41. The control piston is moved back because the force exerted on the working surface A1 exceeds the force exerted on the working surface A2 by the same pressure. When the control piston has reached its upper end position, the operating line 38 is separated from the supply pressure and connected to the return line 12 via the annular groove 43. Thereby, the return stroke of the working piston 22 is effected. As soon as the groove 35 is blocked by the enlarged piston portion 28 add the groove 34 is released by the return stroke surface RF during the return stroke, the full pressure, which acts upon the control surface A3 and drives the control piston into the lower end position, is generated in the control line 37. The sum of the control surfaces A2 and A3 is greater than the control surface A1.

The rear chamber 50 of the hammer housing 20, into which the rearward projection 51 of the working piston extends, is filled with hydraulic fluid. This rear chamber 50 is closed all around and connected to a pressure gas reservoir 52. The pressure gas reservoir 52 contains a gas filling in a gas chamber 53. The gas chamber 53 is limited by a flexible membrane 54 which is gas-impermeable and seals off the rear chamber 50.

An inflow line 55 laterally leads into the rear chamber 50, and on the opposite side, an outflow line 56 leads out of the rear chamber. The outflow line 56 includes a throttle 57 and is connected to the return line 12. The inflow line 55 includes a pressure control valve 58 being connected with the supply line 10. The pressure control valve 58 generates a pressure of 20 bar in the inflow line 55. The operating pressure fed to the supply line amounts to 180 bar.

In the forward end position of the working piston, the front face of the projection 51 is in position 59 which is shown in broken lines in FIG. 1. In this position, the mouths of the inflow line 55 and the outflow line 56 into the rear chamber 50 are unblocked, so that hydraulic fluid can flow through the rear chamber. During the subsequent return stroke of the working piston, the projection 51 closes the lines 55 and 56. The pressure in the rear chamber 50 then increases until the forwardly directed force of the pressure gas reservoir 52 is balanced with the force acting upon the return stroke surface RF. This means that the pressure in the rear chamber 50 is equal to the working pressure (in the supply line 10) multiplied by the area ratio RF/SF. If the front face SF is four times as large as the return stroke surface RF and the working pressure is 180 bar, the pressure in the rear chamber 50 increases to 180/4=45 bar. The pressure of the pressure control valve is rated such that the pressure increases to this value (45 bar) with the return stroke of the working piston. This applies to the maximum working stroke, i.e. when the control grooves 34*a* and 34*b* are closed and the control groove 34*c* is opened.

The embodiment of FIG. 2 is largely similar to that of FIG. 1 so that the following description is restricted to the differences.

According to FIG. 2, the supply line 55 leading into the rear chamber 50 includes a one-way valve 60 which only opens toward the rear chamber 50 but locks in the opposite direction. Here as well, the line 55 is connected to the control valve 58 reducing the pressure in the supply line 10 to a predetermined value (e.g., 20 bar). The outflow line 56*a* is not connected to the return line but with the control groove 35 and the control line 37. When the working piston 22 has reached its forward end position, the ring surface 29 unblocks the control groove 35, so that the latter is now connected to the return line 12 via line 36. Therefore, the outflow line 56*a* is connected to the return line 12 in the forward position of the working piston 22 only. In the subsequent working stroke, the ring edge 29 sweeps over the control groove 35 so that the latter is closed by the working piston and the outflow line 56*a* is blocked.

In the embodiment of FIG. 2, the return stroke surface RF does not sweep over the control groove 35. The reversal at the end of the return stroke is effected by the fact that the pressure in the rear chamber 50 and in the outflow line 56*a*, which acts upon the control surface A3 of the control piston 41, becomes so great that it pushes the control piston 41 into the position shown in FIG. 2 in which the working piston performs its impact stroke. Therefore, the control groove 34 is not necessary in FIG. 2. The reversal of the control piston 41 is effected with the help of the pressure in the rear chamber 50.

The inflow line 55 and the outflow line 56a lead into the rear chamber 50 at a location where they cannot be locked by the projection 51 of the working piston.

Figure 3:
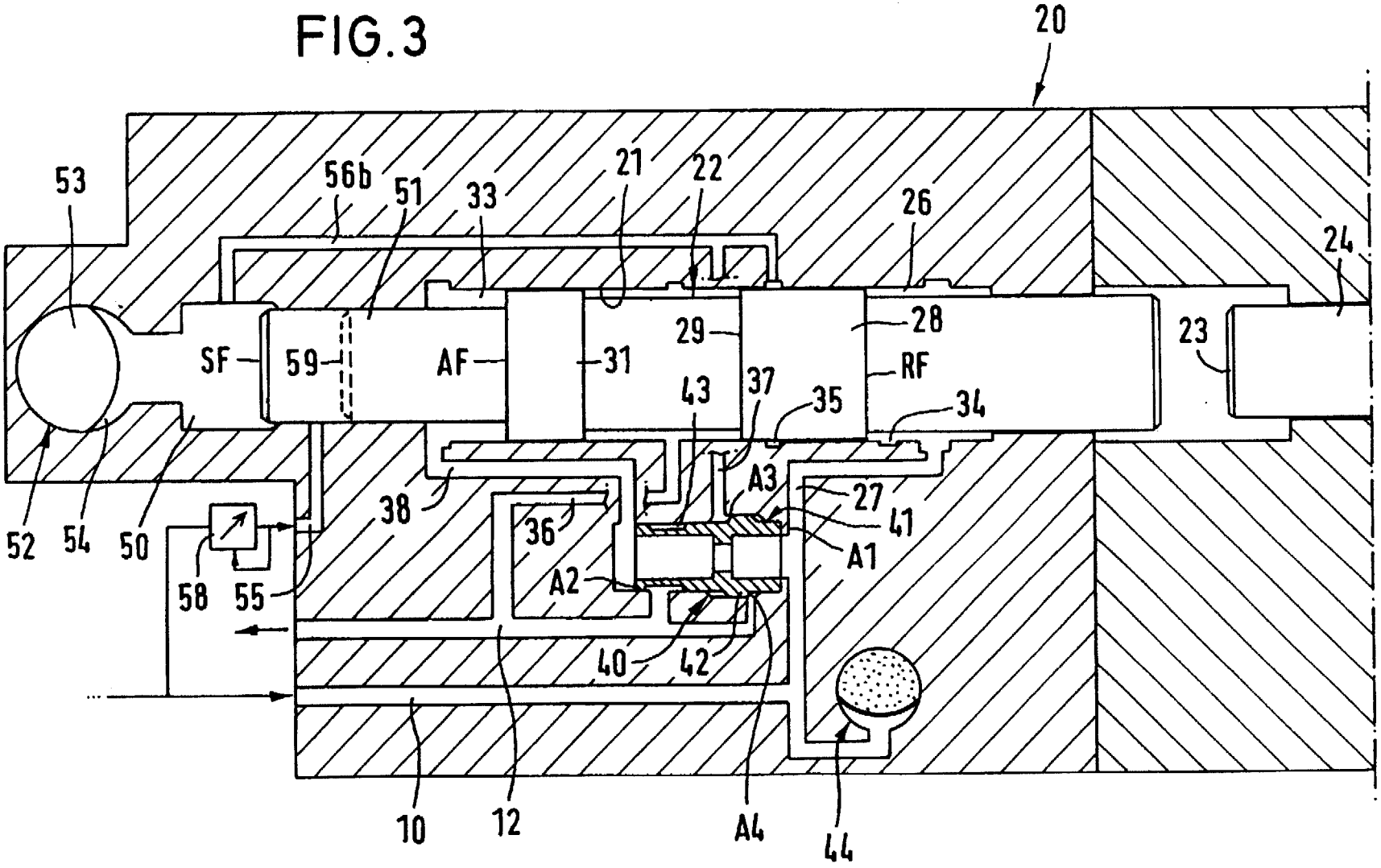
FIG. 3 shows a third embodiment.

The embodiment of FIG. 3 differs from that of FIG. 2 in that the inflow line is locked and unblocked by the projection 51 of the working piston, as is the case in FIG. 1. In contrast, however, the outflow line 56b is not controlled by the working piston in FIG. 3. It is permanently connected to the rear chamber 50, as is the case in FIG. 2.

In both embodiments, FIG. 2 and FIG. 3, the reversal of the control piston 41 is effected by the pressure in the outflow lines 56a and 56b, respectively, into that position which corresponds to the working stroke of the working piston 22. This pressure changes depending on the respective return stroke position assumed by the working piston 22 and depending on the pressure generated by the pressure control valve 58 in the rear chamber 50 while the working piston was in the outmost advance position. This pressure generated in the rear chamber 50 by the pressure control valve 58 is referred to as bias pressure. By changing the bias pressure, that travel length of the working piston during the return stroke can be determined, where the pressure in the outflow line 56a (FIG. 2) or 56b (FIG. 3) is so great that it can reverse the control piston 41. By changing the bias pressure generated by the pressure control valve 58, the extent of the piston stroke of the working piston can be changed. If the bias pressure is small, the working piston covers a long return stroke until the pressure in the outflow lines 56a and 56b, respectively, has become so great that the control piston 41 is reversed. Due to the great return stroke length of the working piston, there is a lesser number of impacts per minute and an increase in impact energy. If the bias pressure in the rear chamber 50 is set to a large value at the pressure control valve 58, the reversal of the control piston is already effected at a small return stroke length of the working piston. In this case, the working piston makes impacts with a high impact frequency and low impact energy.

In the embodiments of FIGS. 2 and 3, a change in the impact number and the impact energy can also be effected by varying the supply pressure supplied to the pressure line 10 while keeping the bias pressure generated by the pressure control valve 58 constant. The control piston 41 forms a pressure balance which is subject to the full high pressure of the pressure line 10 (on the front surfaces A1 and A2), on the one hand, and to the pressure in the outflow line 56a (FIG. 2) or 56b (FIG. 3) acting upon the control surface A3, on the other hand. If the supply pressure is reduced, the impact frequency of the working piston is increased and the impact energy is reduced. If the supply pressure is increased, the impact frequency is reduced and the impact energy is increased.

A change in impact frequency can be effected depending on how far the object has already been advanced into the ground. At the beginning of the advancement of an object into the ground, the operation is initially performed with high impact frequency. If the degree of advancement in the ground is already high, a higher advance is achieved when the impact frequency is reduced and the energy of the individual impacts is increased. The impact energy can also be changed automatically in dependence on the advance force acting upon the impact hammer.

In the embodiment of FIG. 1, the rear chamber 50 is closed during the return stroke of the working piston by the working piston closing the lines 55 and 56. In the embodiment of FIG. 2, the closing of the rear chamber 50 is effected by the one-way valve 60, on the one hand, and by the fact that the annular groove 35 connected with the outflow line 56a is closed by the piston portion 28, while the control line 37 forms a dead end leading to the control cylinder 40. In the embodiment of FIG. 3, the rear chamber 50 is closed by the working piston closing the line 55 and by the piston portion 28 closing the annular groove 35 connected with the outflow line 56b while the control line 37 forms a dead end.

In all embodiments of the impact hammer, the return stroke surface RF must be larger than in that case where there is no gas pad at the rearward end of the working cylinder. The larger return stroke surface RF is necessary because more force has to be raised to compress the gas in the pressure gas reservoir 52. The enlarged return stroke surface RF results in that the oil volume in the forward cylinder chamber 26 becomes larger. With each working stroke, the oil volume is displaced from this cylinder chamber 26. Since the return stroke surface RF, however, is continually subject to the high pressure, the pressurized oil volume displaced from the cylinder chamber 26 remains under pressure. This oil volume need not be supplemented from the external hydraulic pressure source.

Although a preferred embodiment of the invention has been specifically illustrated and described herein, it is to be understood that minor variations may be made in the apparatus without departing from the spirit and scope of the invention, as defined in the appended claims.

I claim:

1. A hydraulic impact hammer, comprising a hammer housing (20) connected to a pressure line (10) and a return line (12) and including a working cylinder (21), a working piston (22) movable in said working cylinder (21), a rear chamber (50) in which a rearward projection (51) of the working piston (22) moves, reversible control means (40, 41) for introducing pressure fluid into the working cylinder (21) in such a manner that the working piston (22) alternately performs a forwardly directed working stroke and a rearwardly directed return stroke, the working piston (22) strikes against an anvil surface (23) during the working stroke, a pressure gas reservoir (52) being connected to the rear chamber (50), the rear chamber (50) being connected to a pressure source via an inflow line (55), a pressure controlled valve (58) in said inflow line (55) for supplying a constant pressure to said rear chamber (50) which is lower than the pressure in the pressure line (10), and the rear chamber (50) remains sealed-off during the return stroke of the working piston (22).

2. The impact hammer according to claim 1 wherein the rear chamber (50) is connected to an outflow line (56; 56a, 56b) which is connected to the return line (12) to bleed the rear chamber (50) when the working piston (22) is near a forward end position thereof.

3. The impact hammer according to claim 2 wherein the inflow line (55) and the outflow line (56; 56a, 56b) are opened only when the working piston (22) is near said forward end position.

4. The impact hammer according to claim 2 wherein at least one of the inflow line (55) and the outflow line (56; 56a, 56b) open into a region of the rear chamber (50) which is traversed by the rearward projection (51) of the working piston (22), whereby one of the inflow line (55) and the outflow line (56) are closed by the working piston (22).

5. The impact hammer according to claim 2 wherein the outflow line (56; 56a, 56b) includes a throttle (56).

6. The impact hammer according to claim 2 wherein the outflow line (56; 56*a*, 56*b* ) is connected to a control line (37) which is pressureless in the forward end position of the working piston (22), and which is separated from the return line (12) by the working piston (22) in the return stroke.

7. The impact hammer according to claim 6, wherein the control line (37) controls the control means (40,41).

8. The impact hammer according to claim 1 wherein the working piston (22) includes a return stroke surface (RF) constantly subject to the pressure in said pressure line (10).

9. The impact hammer according to claim 1 wherein the inflow line (55) includes a one-way valve (60) which opens towards the rear chamber (50).

10. The impact hammer according to claim 1 wherein the reversible control means (40, 41) is operative at the end of the return stroke during which a balance of forces occurs between the pressure acting upon a return stroke surface (RF) of said working piston (22) and the pressure acting upon a front surface (SF) of the working piston (22).

11. The impact hammer according to claim 1 wherein the pressure of the pressure-controlled valve (58) is adjustable to change the length of the return stroke of the working piston (22).

12. The impact hammer according to claim 1 wherein the pressure supplied to the pressure line (10) is adjustable to change the length of the return stroke of the working piston (22).

* * * * *